US009648962B1

(12) United States Patent
Cheng

(10) Patent No.: US 9,648,962 B1
(45) Date of Patent: May 16, 2017

(54) TRANSFORMABLE BABY WALKER

(71) Applicant: JIN SUN GEE PLASTICS CO., LTD., Tainan (TW)

(72) Inventor: Chung-Jen Cheng, Tainan (TW)

(73) Assignee: Jin Sun Gee Plastics Co., Ltd., Tainan (TW)

( * ) Notice: Subject to any disclaimer, the term of this patent is extended or adjusted under 35 U.S.C. 154(b) by 0 days.

(21) Appl. No.: 15/247,590

(22) Filed: Aug. 25, 2016

(51) Int. Cl.
*A47D 13/04* (2006.01)
*B62B 7/10* (2006.01)

(52) U.S. Cl.
CPC ..... *A47D 13/043* (2013.01); *B62B 7/105* (2013.01)

(58) Field of Classification Search
CPC ..... A47D 13/04; A47D 13/102
USPC ..... 280/643, 87.051
See application file for complete search history.

(56) References Cited

U.S. PATENT DOCUMENTS 559,424 A * 5/1896 Thomas et al. ..... A47D 1/02 297/132
2,553,670 A * 5/1951 Notto ..... A47D 13/102 280/43.15
3,003,543 A * 10/1961 Duncan ..... A47D 11/00 280/8
3,326,570 A * 6/1967 Burnham ..... A47D 1/02 280/648
3,331,631 A * 7/1967 Pierson, Jr. ..... A47D 13/102 297/259.4
3,692,359 A * 9/1972 Boucher ..... A47D 1/08 280/30
4,019,751 A * 4/1977 Nakao ..... A47D 1/002 280/31
4,822,030 A * 4/1989 Cone ..... A47D 13/043 280/43.24
D305,750 S * 1/1990 Cone ..... D12/130
5,203,581 A * 4/1993 Jankowski ..... A47D 13/043 16/44
D401,894 S * 12/1998 Cheng ..... D12/130
5,938,218 A * 8/1999 Chuang ..... A47D 1/08 280/30
6,513,869 B1 * 2/2003 Wu ..... A47D 1/02 297/130
7,007,959 B1 * 3/2006 Lu ..... A47D 13/043 280/47.38
7,070,188 B2 * 7/2006 Waldman ..... A47D 9/00 280/31
8,998,227 B1 * 4/2015 Chen ..... A47D 13/102 280/38
9,192,247 B1 * 11/2015 Lu ..... A47D 13/043

* cited by examiner

*Primary Examiner* — Jeffrey J Restifo
(74) *Attorney, Agent, or Firm* — Pepper Hamilton LLP

(57) ABSTRACT

A transformable baby walker includes an upper frame unit, a support unit, two front retaining members, two rear retaining members, two shell units, four latch members, four actuators, and a plurality of casters. A shell member of each of the shell units has a rocking surface and a mounting surface. Each of the casters is mounted on the mounting surface of a corresponding one of the shell units. Each of the shell units is angularly displaceable between a walker position, where the casters are in contact with a floor surface, and a rocker position, where the rocking surface is in contact with the floor surface.

10 Claims, 8 Drawing Sheets

TRANSFORMABLE BABY WALKER

FIELD

The disclosure relates to a baby walker, more particularly to a transformable baby walker.

BACKGROUND

A conventional baby walker, as shown in FIG. 1, includes a lower frame 11, an upper frame 12, a support unit 13 interconnecting the lower and upper frames 11, 12, a seat member 14 connected to the upper frame 12, and a plurality of casters 112 mounted to the lower frame 11. Such conventional baby walker cannot be transformed into a rocking chair.

U.S. Pat. No. 5,845,963 discloses a walking chair having a pair of opposed arcuate side frames, a front rod pivotally connected with corresponding first distal ends of the arcuate side frames, and a rear rod opposed to the front rod and pivotally connected with corresponding second distal ends of the arcuate side frames, such that when a folding device is activated, the arcuate side frames are able to be positioned in place to allow the arcuate side frames to engage with the ground to allow a walking chair to be converted into a rocking chair.

U.S. Pat. No. 6,513,869 discloses a combined baby walker/rocking chair including a chassis, a support, an upper frame, and a seat. The chassis and the upper frame are connected via the support. Two parallel transverse beams are mounted to a lower end of the support. Plural casters are mounted to an underside of the chassis. The chassis having two symmetric arcuate frames and two control devices are constructed to allow a baby walker to be converted into a rocking chair, while providing a stable structure.

SUMMARY

Therefore, an object of the disclosure is to provide a novel transformable baby walker.

According to the disclosure, a transformable baby walker is movable on a floor surface and includes an upper frame unit, a support unit, two front retaining members, two rear retaining members, two shell units, four latch members, four actuators, and a plurality of casters. The upper frame unit includes two guard arms and a front guard piece. Each of the two guard arms extends in a longitudinal direction to terminate at a front arm region and a rear arm region. The two guard arms are spaced apart from each other in a direction transverse to the longitudinal direction. The front guard piece is disposed between the front arm regions of the two guard arms. The front guard piece and the two guard arms define thereamong an accommodation space. The support unit includes two support rods and two bracing members. Each of the two support rods is disposed to be spaced apart from a corresponding one of the two guard arms in an upright direction transverse to both the longitudinal and transverse directions. Each of the two support, rods extends along a rod axis in the longitudinal direction to terminate at a front rod end segment and a rear rod end segment. Each of the two bracing members interconnects the corresponding one of the two guard arms with a corresponding one of the two support rods. The two front retaining members are mounted respectively on the front rod end segments of the two support rods. Each of the front retaining members has a front retaining surface, a first retaining slot, and a second retaining slot. The front retaining surface extends in a circumferential direction about the rod axis of the corresponding one of the two support rods. The first retaining slot is formed in the front retaining surface. The second retaining slot is formed in the front retaining surface and is angularly displaced from the first retaining slot. The two rear retaining members are mounted respectively on the rear rod end segments of the two support rods. Each of the rear retaining members has a rear retaining surface, a first retaining slot formed in the rear retaining surface, and a second retaining slot formed in the rear retaining surface. The rear retaining surface extends in the circumferential direction about the rod axis of the corresponding one of the two support rods. The second retaining slot is angularly displaced from the first retaining slot. Each of the two shell units includes a shell member, a front pivot shell, a rear pivot shell, a front guiding member, and a rear guiding member. The shell member extends alone a lengthwise line to terminate at front and rear end regions opposite to each other in the longitudinal direction. The shell member has a mounting surface and a rocking surface. The mounting and rocking surfaces define therebetween an included angle. The front and rear pivot shells extend respectively from the front and rear end regions of the shell member and transversely to the lengthwise line. Each of the front and rear pivot shells has inner and outer surfaces, and a through hole extending through the inner and outer surfaces. Each of the front and rear guiding members is configured to slidably engage a corresponding one of the front and rear rod end segments of the two support rods, and is configured to couple a corresponding one of the front and rear pivot shells to the corresponding one of the front and rear rod end segments of the two support rods, such that each of the two shell units is guided to be angularly displaceable between a walker position, where the mounting surface faces the floor surface and the through hole of each of the front and rear pivot shells is in register with the first retaining slot of a corresponding one of the front and rear retaining members, and a rocker position, were the rocking surface is in contact with the floor surface and the through hole of each of the front and rear pivot shells is in register with the second retaining slot of the corresponding one of the front and rear retaining members. Each of the four latch members is disposed in the through hole of the corresponding one of the front and rear pivot shells of the two shell units, and has an actuated end and an inserted end. The actuated end is disposed outwardly of the corresponding one of the front and rear pivot shells of the two shell units. The inserted end is lengthwise opposite to the actuated end, and is configured to be movable between a latched position, where the inserted end is inserted into one of the first and second retaining slots of the corresponding one of the front and rear retaining members so as to retain a corresponding one of the shell units in the walker or rocker position, and an unlatched position, where the inserted end is disengaged from the corresponding one of the front and rear retaining members so as to permit angular movement of the corresponding one of the shell units. Each of the four actuators is coupled to the actuated end of a corresponding one of the latch members so as to move the inserted end of the corresponding one of the latch members between the latched and unlatched positions. Each of the casters is mounted on the mounting surface of the shell member of the corresponding one of the shell units. The plurality of casters are disposed to be in contact with the floor surface when each of the two shell units is in the walker position.

BRIEF DESCRIPTION OF THE DRAWINGS

Other features and advantages of the disclosure will become apparent in the following detailed description of the embodiment with reference to the accompanying drawings, in which.

DETAILED DESCRIPTION

Figure 1:
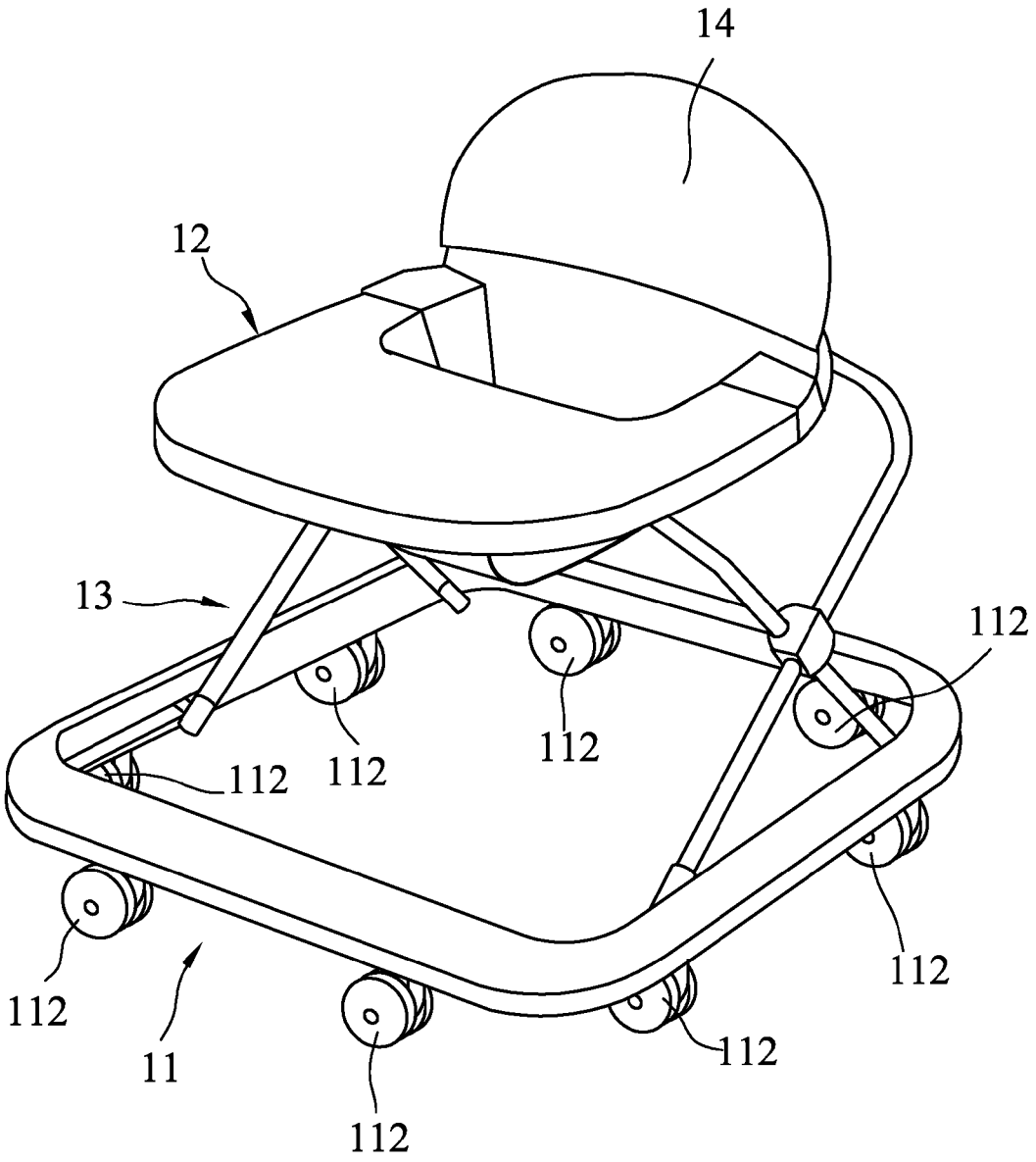
Fig. 1 PRIOR ART
FIG. 1 is a perspective view of a conventional baby walker.
Figure 2:
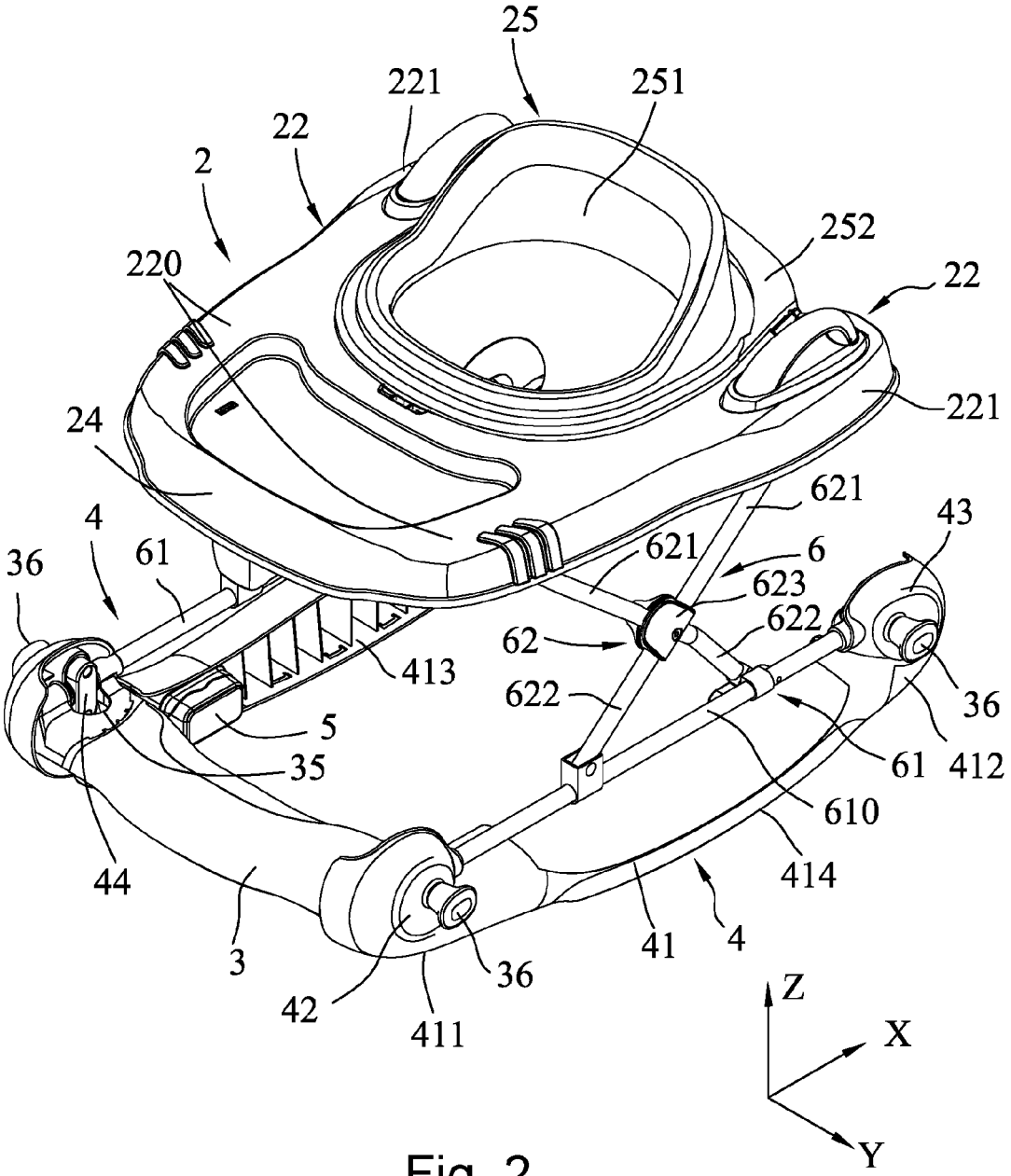
FIG. 2 is a perspective view of a transformable baby walker according to the disclosure, the transformable baby walker being in a rocker position.

A transformable baby walker according to an embodiment of the disclosure can be used for helping infants to learn to walk (see FIG. 3), and can be transformed into a baby rocking chair (see FIG. 2).

Figure 3:
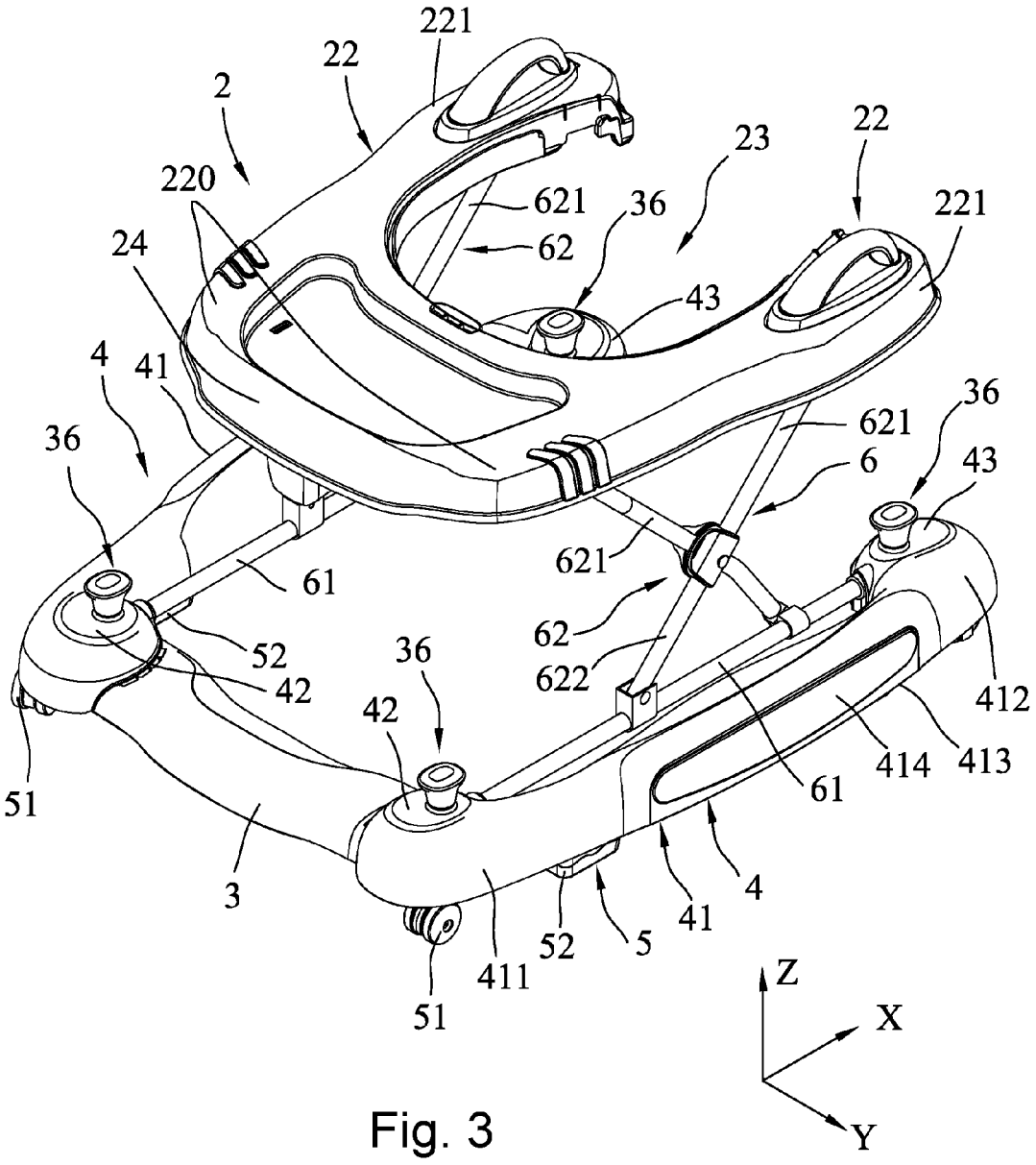
FIG. 3 is a perspective view of the transformable baby walker in a walker position, in which a seat member is removed.
Figure 4:
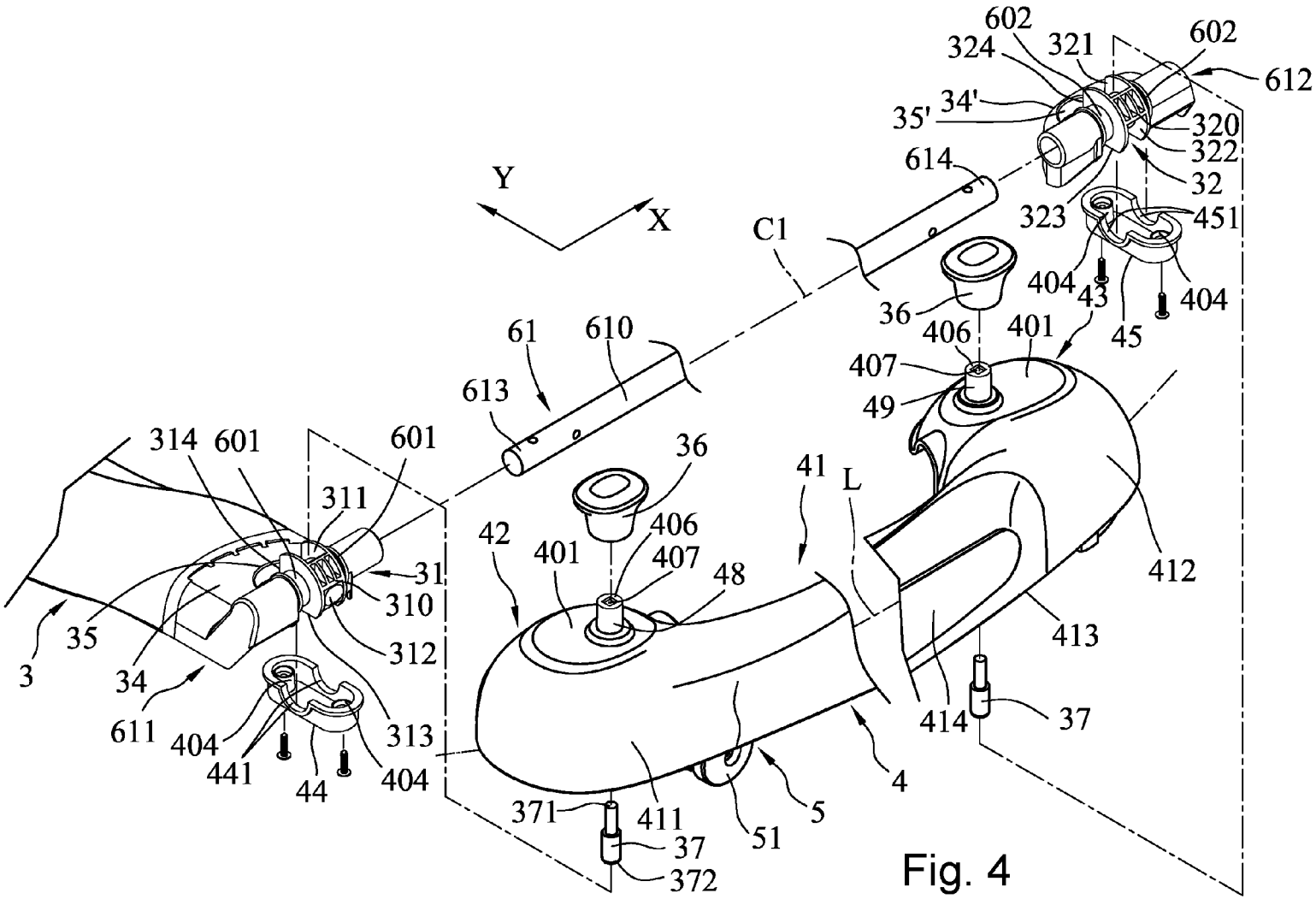
FIG. 4 is a fragmentary exploded perspective view of the transformable baby walker.

As shown in FIGS. 2 to 4, the transformable baby walker includes an upper frame unit 2, a support unit 6, two front retaining members 31 (only one is shown in FIG. 4), two rear retaining members 32 (only one is shown in FIG. 4), two shell units 4, four latch members 37 (only two are shown in FIG. 4), four actuators 36, and a plurality of caster units 5.

The upper frame unit 2 includes two guard arms 22 and a front guard piece 24.

Each of the two guard arms 22 extends in a longitudinal direction (X) to terminate at a front arm region 220 and a rear arm region 221. The two guard arms 22 are spaced apart from each other in a direction (Y) transverse to the longitudinal direction (X).

The front guard piece 24 is disposed between the front arm regions 220 of the two guard arms 22. The front guard piece 24 and the two guard arms 22 define thereamong an accommodation space 23 as shown in FIG. 3.

In this embodiment, as shown in FIG. 2, the upper frame unit 2 further includes a seat member 25 which is detachably fitted in the accommodation space 23, and which has a seat segment 251 and a connecting segment 252. The seat segment 251 is configured to permit a baby to seat thereon. The connecting segment 252 extends in the transverse direction (Y) to terminate at left and right ends which are detachably connected to the rear arm regions 221 of the two guard arms 22, respectively. When the transformable baby walker is used for walking, the seat member 25 may be removed to permit an infant to stand.

The support unit 6 includes two support rods 61 and two bracing members 62.

Each of the support rods 61 is disposed to be spaced apart from a corresponding one of the two guard arms 22 in an upright direction (Z) transverse to both the longitudinal and transverse directions (X, Y). As shown in FIG. 4, each of the two support rods 61 extends along a rod axis (C1) in the longitudinal direction (X) to terminate at a front rod end segment 611 and a rear rod end segment 612. In this embodiment, each of the two support rods 61 has a rod body 610 which has a front end 613 and a rear end 614. The front end. 613 is secured to the front rod end segment 611, and the rear end 614 is secured to the rear rod end segment 612. Furthermore, the front rod end segment 611 has two front annular zones 601, and the rear rod end segment 612 has two rear annular zones 602.

Referring back to FIGS. 2 and 3, it is shown that each of the two bracing members 62 interconnects the corresponding one of the two guard arms 22 with a corresponding one of the two support rods 61. In this embodiment, each of the two bracing members 62 includes two upper sections 621, two lower sections 622, and a connector 623. Upper ends of the upper sections 621 are pivotally connected to the corresponding one of the two guard arms 22. Lower ends of the lower sections 622 are slidably connected to the rod body 610 of the corresponding one of the two support rods 61. The upper and lower sections 621, 622 are connected by the connector 623. The bracing members 62 may have many variable designs which are well-known in the art, and therefore details thereof are omitted for clarity.

Figure 5:
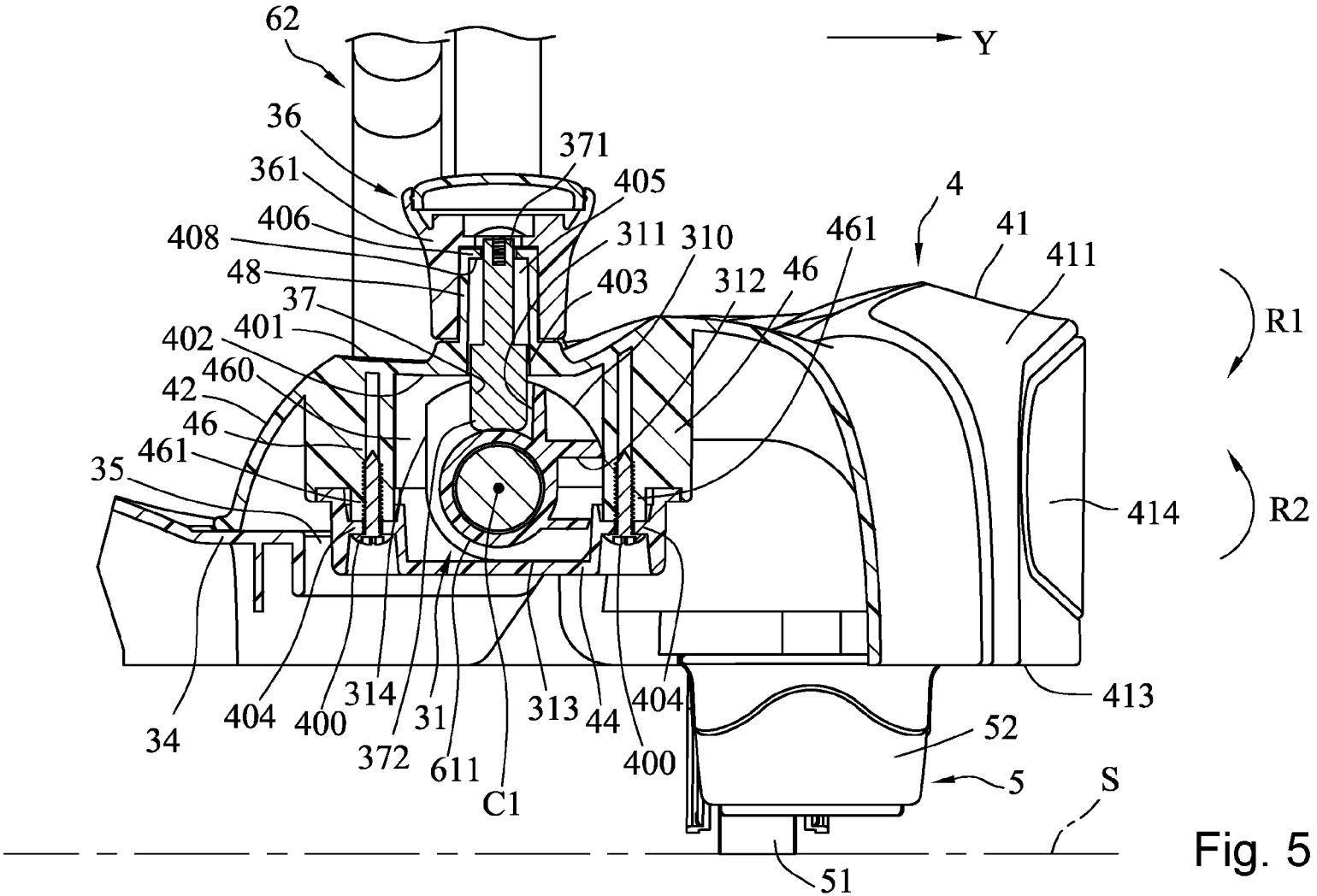
FIG. 5 is a fragmentary cross-sectional view of the transformable baby walker illustrating that a latch member is inserted into a first retaining slot of a front retaining member.

As shown in FIGS. 4 and 5, the two front retaining members 31 (only one is shown) are mounted respectively on the front rod end segments 611 of the two support rods 61. Each of the front retaining members 31 has a front retaining surface 310, a first retaining slot 311 and a second retaining slot 312. The front retaining surface 310 extends in a circumferential direction about the rod axis (C1) of the corresponding one of the two support rods 61. The first retaining slot 311 is formed in the front retaining surface 310. The second retaining slot 312 is formed in the front retaining surface 310 and is angularly displaced from the first retaining slot 311 with respect to the rod axis (C1) of the corresponding one of the two support rods 61.

In this embodiment, each of the front retaining members 31 is mounted between the front annular zones 601 of the front rod end segment 611 of the corresponding one of the two support rods 61.

In this embodiment, each of the front retaining members 31 further has a first engaging surface 313 displaced angularly from the front retaining surface 310, and a second engaging surface 314 displaced angularly from the first engaging surface 313 and the front retaining surface 310.

In this embodiment, each of the front retaining members 31 is integrally formed with the front rod end segment 611 of the corresponding one of the two support rods 61.

Figure 6:
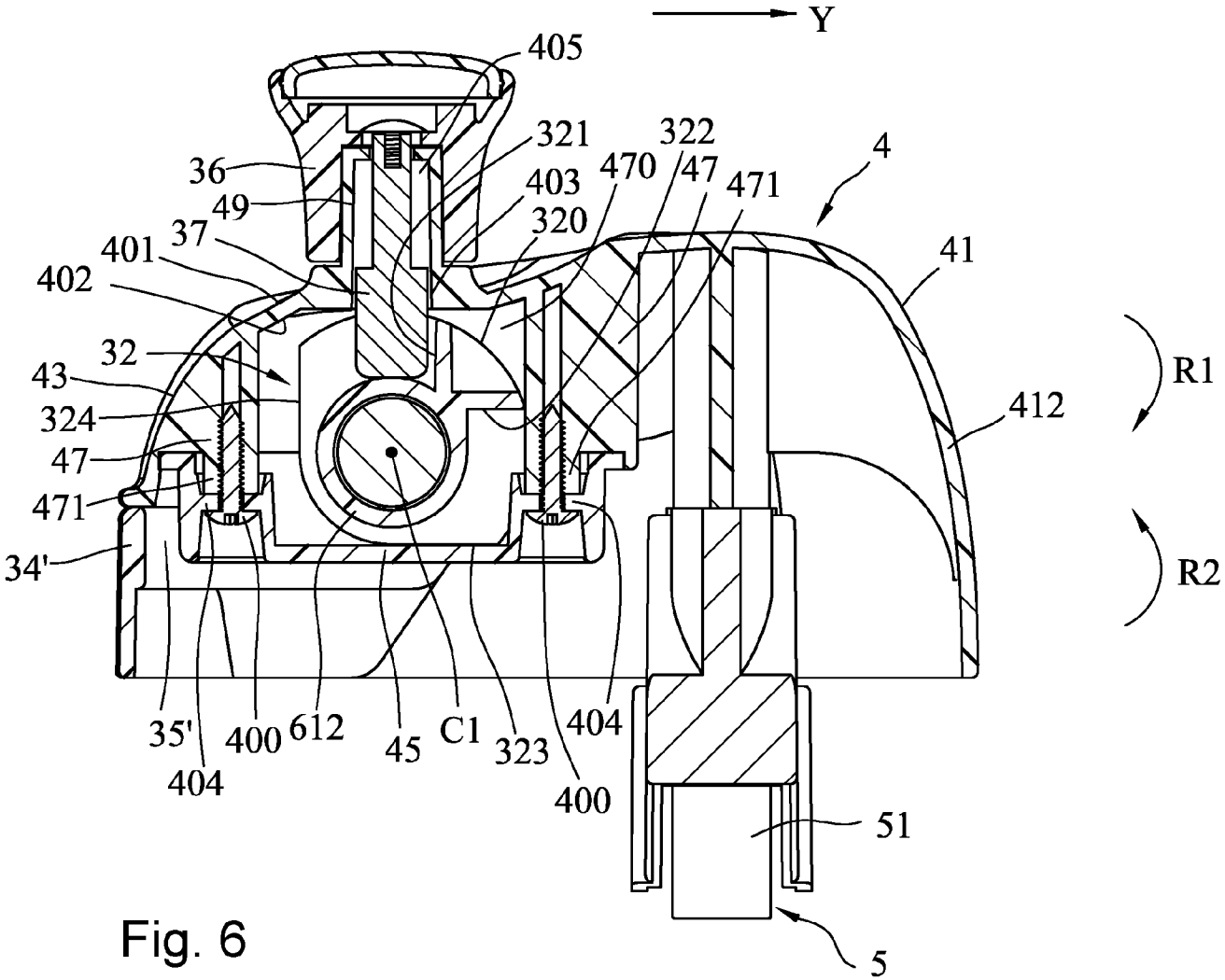
FIG. 6 is a fragmentary cross-sectional view of the transformable baby walker illustrating that another latch member is inserted into a first retaining slot of a rear retaining member.

As shown in FIGS. 4 and 6, the two rear retaining members 32 (only one is shown) are mounted respectively on the rear rod end segments 612 of the two support rods 61. Each of the rear retaining members 32 has a rear retaining surface 320, a first retaining slot 321, and a second retaining slot 322. The rear retaining surface 320 extends in the circumferential direction about the rod axis (C1) of the corresponding one of the two support rods 61. The first retaining slot 321 is formed in the rear retaining surface 320. The second retaining slot 322 is formed in the rear retaining surface 320 and is angularly displaced from the first retaining slot 321 with respect to the rod axis (C1) of the corresponding one of the two support rods 61.

In this embodiment, each of the rear retaining members 32 is mounted between the rear annular zones 602 of the rear rod end segment 612 of the corresponding one of the two support rods 61.

In this embodiment, each of the rear retaining members 32 further has a first engaging surface 323 displaced angularly from the rear retaining surface 320, and a second engaging surface 324 displaced angularly from the first engaging surface 323 and the rear retaining surface 320.

In this embodiment, each of the rear retaining members 32 is integrally formed with the rear rod end segment 612 of the corresponding one of the two support rods 61.

As best shown in FIG. 4, each of the two shell units 4 has a shell member 41, a front pivot shell 42, a rear pivot shell 43, a front guiding member 44, and a rear guiding member 45.

The shell member 41 extends along a lengthwise line (L) to terminate at front and rear end regions 411, 412 opposite to each other in the longitudinal direction (X). The shell member 41 has a mounting surface 413 and a rocking surface 414. The mounting and rocking surfaces 413, 414 define therebetween an included angle. In this embodiment, the shell member 41 is spaced apart from the corresponding one of the two support rods 61, and the shell member 41 has cut-out portions for reducing the weight thereof and may be formed with a reinforced rib structure.

The front pivot shell 42 extends from the front end region 411 and transversely to the lengthwise line (L). The rear pivot shell 43 extends from the rear end region 412 of the shell member 41 and transversely to the lengthwise line (L). As shown in FIGS. 5 and 6, each of the front and rear pivot shells 42, 43 has inner and outer surfaces 401, 402, and a through hole 403 extending through the inner and outer surfaces 401, 402.

Figure 7:
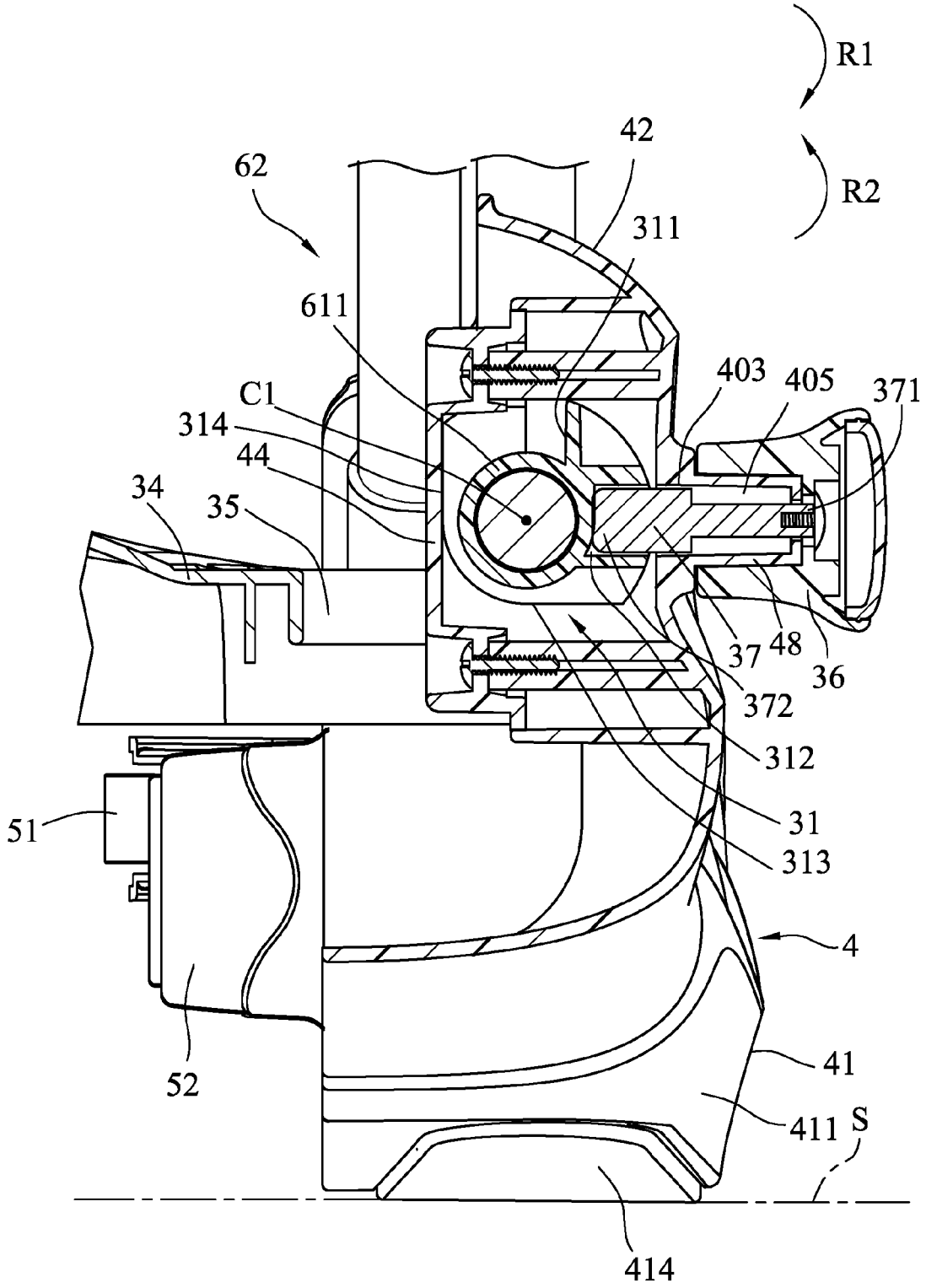
FIG. 7 is a fragmentary cross-sectional view similar to FIG. 5 but illustrating that the latch member is inserted into a second retaining slot of the front retaining member.

Referring back to FIGS. 4 to 6, it can be observed that each of the front and rear guiding members 44, 45 is configured to slidably engage a corresponding one of the front and rear rod end segments 611, 612 of the two support rods 61, and is configured to couple a corresponding one of the front and rear pivot shells 42, 43 to the corresponding one of the front and rear rod end segments 611, 612 of the two support rods 61, such that each of the two shell units 4 is guided to be angularly displaceable between a walker position (see FIGS. 3, 5, and 6) and a rocker position (see FIGS. 2 and 7).

As shown in FIGS. 3, 5, and 6, in the walker position, the mounting surface 413 faces a floor surface (S), the through hole 403 of the front pivot shell 42 is in register with the first retaining slot 311 of a corresponding one of the front retaining members 31, and the through hole 403 of the rear pivot shell 43 is in register with the first retaining slot 321 of a corresponding one of the rear retaining members 32. In this embodiment, the first engaging surface 313 of each of the front retaining members 31 is in frictional engagement with the front guiding member 44 of a corresponding one of the shell units 4 in the walker position (see FIG. 5), and the first engaging surface 323 of each of the rear retaining members 32 is in frictional engagement with the rear guiding member 45 of the corresponding one of the shell units 4 in the walker position (see FIG. 6).

As shown in FIGS. 2 and 7, in the rocker position, the rocking surface 414 is in contact with the floor surface (S), the through hole 403 of the front pivot shell 42 is in register with the second retaining slot 312 of the corresponding one of the front retaining members 31, and the through hole 403 of the rear pivot shell 43 is in register with the second retaining slot 322 of the corresponding one of the rear retaining members 32. In this embodiment, the second engaging surface 314 of each of the front retaining members 31 is in frictional engagement with the front guiding member 44 of the corresponding one of the shell units 4 in the rocker position (see FIG. 7), and the second engaging surface 324 of each of the rear retaining members 32 is in frictional engagement with the rear guiding member 45 of the corresponding one of the shell units 4 in the rocker position.

In this embodiment, each of the front and rear guiding members 44, 45 extends lengthwise to terminate at two mounting areas 404. Each of the shell units 4 further includes two front mounting walls 46 and two rear mounting walls 47.

As shown in FIG. 5, the two front mounting walls 46 define therebetween a front inner space 460 to accommodate the corresponding one of the front retaining members 31. The two front mounting walls 46 extend from the inner surface 401 of the front pivot shell 42 to terminate at two front mount ends 461 that are respectively secured to the two mounting areas 404 of the front guiding member 44 so as to enclose the front inner space 460. As shown in FIG. 5, the two front mount ends 461 are respectively secured to the two mounting areas 404 of the front guiding member 44 by two screws 400.

As shown in FIG. 6, the two rear mounting walls 47 define therebetween a rear inner space 470 to accommodate the corresponding one of the rear retaining members 32. The two rear mounting walls 47 extend from the inner surface 402 of the rear pivot shell 43 to terminate at two rear mount ends 471 that are respectively secured to the two mounting areas 404 of the rear guiding member 45 so as to enclose the rear inner space 470. As shown in FIG. 6, the two rear mount ends 471 are respectively secured to the two mounting areas 404 of the rear guiding member 45 by two screws 400.

In this embodiment, as shown in FIG. 4, the front guiding member 44 has two front engaging grooves 441 which are spaced apart from each other in the longitudinal direction (X), and which are configured to pivotably engage the front annular zones 601 of the front rod end segment 611 of the corresponding one of the two support rods 61, respectively, so as to permit the front guiding member 44 to pivotably ride on the front rod end segment 611 of the corresponding one of the two support rods 61.

Similarly, the rear guiding member 45 has two rear engaging grooves 451 which are spaced apart from each other in the longitudinal direction (X), and which are configured to pivotably engage the rear annular zones 602 of the rear rod end segment 612 of the corresponding one of the two support rods 61, respectively, so as to permit the rear guiding member 45 to pivotably ride on the rear rod end segment 612 of the corresponding one of the two support rods 61.

In this embodiment, the transformable baby walker further includes a crosspiece 3 which extends in the transverse direction (Y) and which interconnects the front rod end segments 611 of the two support rods 61. The crosspiece 3 has two piece end regions 34 connected to the front rod end segments 611 of the two support rods 61, respectively. Each of the two piece end regions 34 has a cutout area 35 configured to allow pivotal movement of the front guiding member 44 of the corresponding one of the she units 4.

In this embodiment, the rear rod end segment 612 of each of the two support rods 61 has a rest region 34' which extends in a radial direction with respect to the rod axis (C1), and which is configured to permit the rear pivot shell 43 of the corresponding one of the shell units 4 in the walker position to rest thereon. The rest region. 34' has a cutout area 35' configured to allow pivotal movement of the rear guiding member 45 of the corresponding one of the shell units 4.

Each of the four latch members 37 is disposed in the through hole 403 of the corresponding one of the front and rear pivot shells 42, 43 of the two shell units 4. Each of the four latch members 37 has an actuated end 371 and an inserted end 372.

The actuated end 371 is disposed outwardly of the corresponding one of the front and rear pivot shells 42, 43 of the two shell units 4.

Figure 8:
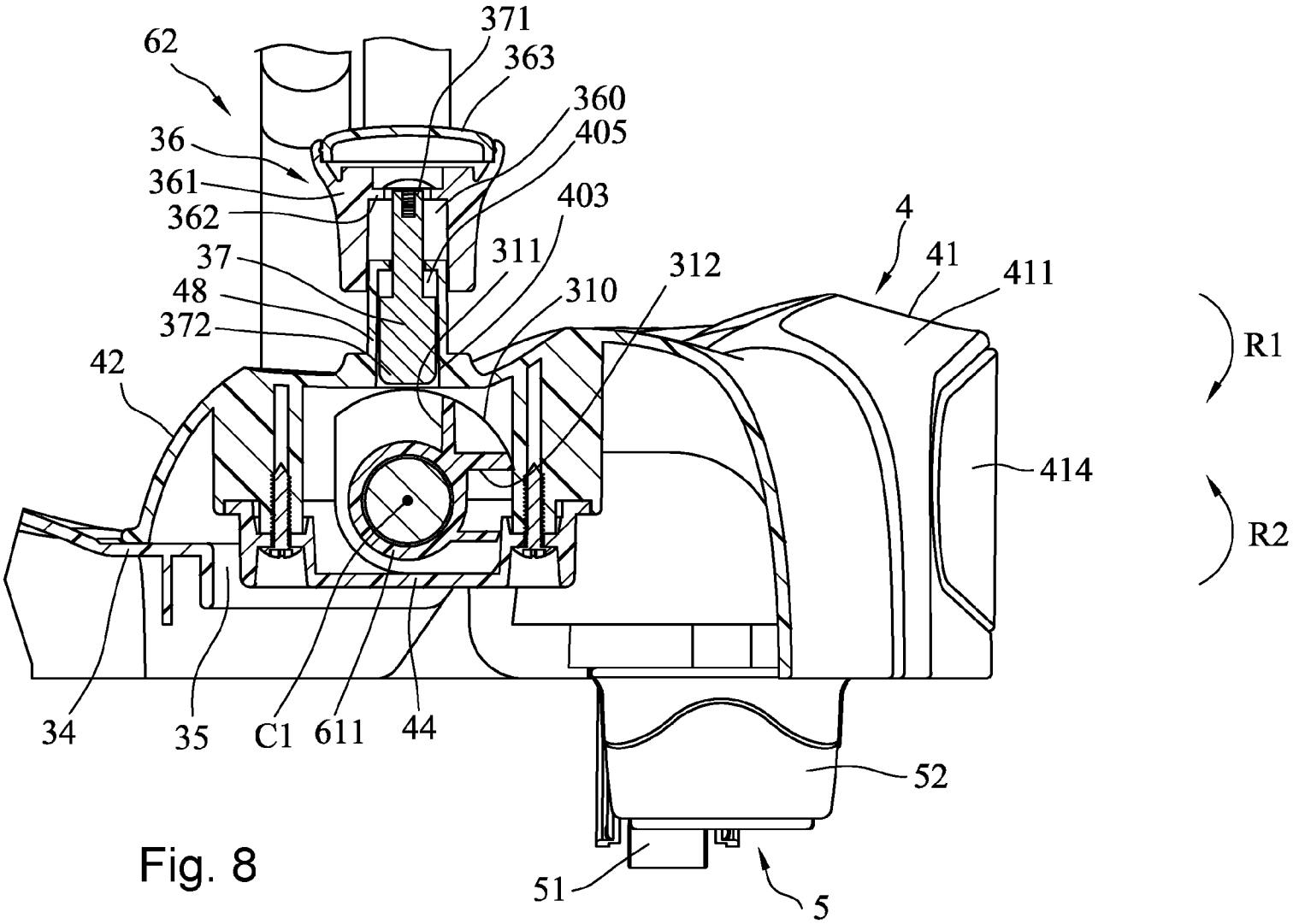
FIG. 8 is a fragmentary cross-sectional view similar to FIG. 5 but illustrating that the latch member is displaced from the first retaining slot of the front retaining member.

The inserted end 372 is lengthwise opposite to the actuated end 371, and is configured to be movable between a latched position (see FIGS. 5, 6, and 7) and an unlatched position (see FIG. 8).

In the latched position, the inserted end 372 is inserted into one of the first and second retaining slots 311, 312, 321, 322 of a corresponding one of the front and rear retaining members 31, 32 so as to retain the corresponding one of the shell units 4 in the walker or rocker position.

In the unlatched position, as shown in FIG. 8, the inserted end 372 is disengaged from the corresponding one of the front and rear retaining members 31, 32 so as to permit angular movement of the corresponding one of the shell units 4.

When the inserted end 372 of each of the latch members 37 is in the unlatched position, for displacing from the walker position to the rocker position, each of the shell units 4 is angularly displaced about the rod axis (C1) of the corresponding one of the two support rods 61 in a clockwise direction (R1) by 90°. Similarly, for displacing from the rocker position to the walker position, each of the shell units 4 is angularly displaced about the rod axis (C1) of the corresponding one of the two support rods 61 in a counterclockwise direction (R2) by 90°.

In this embodiment, each of the shell units 4 further includes a front hollow post 48 and a rear hollow post 49 which are formed respectively on the outer surfaces 401 of the front and rear pivot shells 42, 43. Each of the front and rear hollow posts 48, 49 defines therein a guiding hole 405 which is in register with the through hole 403 of the corresponding one of the front and rear pivot shells 42, 43, and which is configured to guide movement of a corresponding one of the latch members 37.

As shown in FIGS. 4 to 6, each of the front and rear hollow posts 48, 49 includes an end wall 406 having a through bore 407 and an inner abutment surface 408. The through bore 407 is configured to permit the actuated end 371 of the corresponding one of the latch members 37 to be disposed outwardly of the end wall 406. The inner abutment surface 408 is configured to limit movement of the corresponding one of the latch members 37.

Each of the four actuators 36 is coupled to the actuated end 371 of the corresponding one of the latch members 37 so as to move the inserted end 372 of the corresponding one of the latch members 37 between the latched and unlatched positions.

In this embodiment, as best shown in FIG. 8, each of the actuators 36 has a hollow head 361, a mount piece 362, and a face cover 363.

The hollow head 361 defines a hollow space 360 configured to receive therein a corresponding one of the front and rear hollow posts 48, 49 of the shell units 4.

The mount piece 362 is disposed to span the hollow space 360, and is configured to secure the actuated end 371 of the corresponding one of the latch members 37 to the hollow head 361.

The face cover 363 is disposed to conceal the mount piece 362.

Each of the caster units 5 is disposed on the mounting surface 413 of the shell member 41 of the corresponding one of the shell units 4, and has a caster 51 and a caster brake 52. When each of the two shell units 4 is in the walker position, the casters 51 of the caster units 5 are disposed to be in contact with the floor surface (S) so as to permit the transformable baby walker to more on the floor surface (S). The caster 51 and the caster brake 52 are well-known in the art, and therefore details thereof are omitted for clarity.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal, number and so forth means that a particular feature, structure, or characteristic may be included in the practice of the disclosure, it should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What I claimed is:

1. A transformable baby walker movable on a floor surface, comprising an upper frame unit including two guard arms each extending in a longitudinal direction to terminate at a front arm region and a rear arm region, said two guard arms being spaced apart from each other in a direction transverse to the longitudinal direction, and a front guard piece disposed between said front arm regions of said two guard arms, said front guard piece and said two guard arms defining thereamong an accommodation space;

a support unit including two support rods each being disposed to be spaced apart from a corresponding one of said two guard arms in an upright direction transverse to both the longitudinal and transverse directions, each of said two support rods extending along a rod axis in the longitudinal direction to terminate at a front rod end segment and a rear rod end segment, and two bracing members each interconnecting the corresponding one of said two guard arms with a corresponding one of said two support rods;

two front retaining members mounted respectively on said front rod end segments of said two support rods, each of said front retaining members having a front retaining surface extending in a circumferential direction about the rod axis of the corresponding one of said two support rods, a first retaining slot formed in said front retaining surface, and a second retaining slot formed in said front retaining surface and angularly displaced from said first retaining slot;

two rear retaining members mounted respectively on said rear rod end segments of said two support rods, each of said rear retaining members having a rear retaining surface extending in the circumferential direction about the rod axis of the corresponding one of said two support rods, a first retaining slot formed in said rear retaining surface, and a second retaining slot formed in said rear retaining surface and angularly displaced from said first retaining slot;

two shell units each including a shell member extending along a lengthwise line to terminate at front and rear end regions opposite to each other in the longitudinal direction, said shell member having a mounting surface and a rocking surface, said mounting and rocking surfaces defining therebetween an included angle, a front pivot shell and a rear pivot shell which extend respectively from said front and rear end regions of said shell member and transversely to the lengthwise line, each of said front and rear pivot shells having inner and outer surfaces, and a through hole extending through said inner and outer surfaces, and a front guiding member and a rear guiding member each being configured to slidably engage a corresponding one of said front and rear rod end segments of said two support rods, and each being configured to couple a corresponding one of said front and rear pivot shells to the corresponding one of said front and rear rod end segments of said two support rods, such that each of said two shell, units is guided to be angularly displaceable between a walker position, where said mounting surface faces the floor surface and said through hole of each of said front and rear pivot shells is in register with said first retaining slot of a corresponding one of said front and rear retaining members, and a rocker position, where said rocking surface is in contact with the floor surface and said through hole of each of said front and rear pivot shells is in register with said second retaining slot of the corresponding one of said front and rear retaining members;

four latch members each being disposed in said through hole of the corresponding one of said front and rear pivot shells of said two shell units, and each having an actuated end disposed outwardly of the corresponding one of said front and rear pivot shells of said two shell units, and an inserted end which is lengthwise opposite to said actuated end, and which is configured to be movable between a latched position, where said inserted end is inserted into one of said first and second retaining slots of the corresponding one of said front and rear retaining members so as to retain a corresponding one of said shell units in the walker or rocker position, and an unlatched position, where said inserted end is disengaged from the corresponding one of said front and rear retaining members so as to permit angular movement of the corresponding one of said shell units;

four actuators each being coupled to said actuated end of a corresponding one of said latch members so as to move said inserted end of the corresponding one of said latch members between the latched and unlatched positions; and a plurality of casters each being mounted on said mounting surface of said shell member of the corresponding one of said shell units, said plurality of casters being disposed to be in contact with the floor surface when each of said two shell units is in the walker position.

2. The transformable baby walker according to claim 1, wherein each of said front and rear guiding members extends lengthwise to terminate at two mounting areas, each of said shell units further including two front mounting walls which define therebetween a front inner space to accommodate a corresponding one of said front retaining members, and which extend from said inner surface of said front pivot shell to terminate at two front mount ends that are respectively secured to said two mounting areas of said front guiding member so as to enclose said front inner space, and two rear mounting walls which define therebetween a rear inner space to accommodate a corresponding one of said rear retaining members, and which extend from said inner surface of said rear pivot shell to terminate at two rear mount ends that are respectively secured to said two mounting areas of said rear guiding member so as to enclose said rear inner space.

3. The transformable baby walker according to claim 2, wherein:

said front rod end segment has two front annular zones, each of said front retaining members being mounted between said front annular zones of said front rod end segment of the corresponding one of said two support rods;

said rear rod end segment has two rear annular zones, each of said rear retaining members being mounted between said rear annular zones of said rear rod end segment of the corresponding one of said two support rods;

said front guiding member has two front engaging grooves which are spaced apart from each other in the longitudinal direction, and which are configured to pivotably engage said front annular zones of said front rod end segment of the corresponding one of said two support rods, respectively, so as to permit said front guiding member to pivotably ride on said front rod end segment of the corresponding one of said two support rods; and said rear guiding member has two rear engaging grooves which are spaced apart from each other in the longitudinal direction, and which are configured to pivotably engage said rear annular zones of said rear rod end segment of the corresponding one of said two support rods, respectively, so as to permit said rear guiding member to pivotably ride on said rear rod end segment of the corresponding one of said two support rods.

4. The transformable baby walker according to claim 3, further comprising a crosspiece which extends in the transverse direction and which interconnects said front rod end segments of said two support rods, said crosspiece having two piece end regions connected to said front rod end segments of said two support rods, respectively, each of said two piece end regions having a cutout area configured to allow pivotal movement of said front guiding member of the corresponding one of said shell units.

5. The transformable baby walker according to claim 1, wherein:

each of said front retaining members further has a first engaging surface which is angularly displaced from said front retaining surface, and which is in frictional engagement with said front guiding member of the corresponding one of said shell units in the walker position, and a second engaging surface which is angularly displaced from said first engaging surface and said front retaining surface, and which is in frictional engagement with said front guiding member of the corresponding one of said shell units in the rocker position; and each of said rear retaining members further has a first engaging surface which is angularly displaced from said rear retaining surface, and which is in frictional engagement with said rear guiding member of the corresponding one of said shell units in the walker position, and a second engaging surface which is angularly displaced from said first engaging surface and said rear retaining surface, and which is in frictional engagement with said rear guiding member of the corresponding one of said shell units in the rocker position.

6. The transformable baby walker according to claim 1, wherein each of said shell units further includes a front hollow post and a rear hollow post which are formed respectively on said outer surfaces of said front and rear pivot shells, each of said front and rear hollow posts defining therein a guiding hole which is in register with said through hole of the corresponding one of said front and rear pivot shells, and which is configured to guide movement of the corresponding one of said latch members.

7. The transformable baby walker according to claim 6, wherein each of said front and rear hollow posts includes an end wall having a through bore configured to permit said actuated end of the corresponding one of said latch members to be disposed outwardly of said end wall, and an inner abutment surface configured to limit movement of the corresponding one of said latch members.

8. The transformable baby walker according to claim 7, wherein each of said actuators has a hollow head defining a hollow space which is configured to receive therein a corresponding one of said front and rear hollow posts of said shell units, and a mount piece disposed to span said hollow space, and configured to secure said actuated end of the corresponding one of said latch members to said hollow head.

9. The transformable baby walker according to claim 8, wherein each of said actuators further has a face cover disposed to conceal said mount piece.

10. The transformable baby walker according to claim 1, wherein said upper frame unit further includes a seat member which is detachably fitted in said accommodation space.

* * * * *